US005349332A

United States Patent [19]

Ferguson et al.

[11] Patent Number: 5,349,332

[45] Date of Patent: Sep. 20, 1994

[54] EAS SYSTEM WITH REQUENCY HOPPING

[75] Inventors: David B. Ferguson, Delary Beach; LeRoy A. Booker, Pompano Beach; Craig R. Szklany, Boyton Beach, all of Fla.

[73] Assignee: Sensormatic Electronics Corportion, Deerfield Beach, Fla.

[21] Appl. No.: 959,685

[22] Filed: Oct. 13, 1992

[51] Int. Cl.[5] ..... G08B 13/187

[52] U.S. Cl. ..... 340/572; 340/551

[58] Field of Search ..... 340/572, 551

[56] References Cited

U.S. PATENT DOCUMENTS

| | | | |
|---|---|---|---|
| 3,868,669 | 2/1975 | Minasy | 340/572 |
| 4,063,229 | 12/1977 | Welsh et al. | 340/572 |
| 4,139,844 | 2/1979 | Reeder | 340/572 |
| 4,212,002 | 7/1980 | Williamson | 340/572 |
| 4,352,098 | 9/1982 | Stephen et al. | 340/572 |
| 4,356,477 | 10/1982 | Vandebult | 340/572 |
| 4,429,302 | 1/1984 | Vandebult | 340/572 |
| 4,642,640 | 2/1987 | Woolsey et al. | 342/42 |
| 4,736,207 | 4/1988 | Siikarla et al. | 343/895 |
| 5,109,217 | 4/1992 | Siikarla et al. | 340/572 |

OTHER PUBLICATIONS

Schilling, Donald L. et al., "Spread Spectrum Goes Commercial" *IEEE Spectrum*, Aug. 1990.

*Primary Examiner*—Glen Swann

*Attorney, Agent, or Firm*—Robin, Blecker, Daley & Driscoll

[57] ABSTRACT

An EAS system in which a transmitter transmits an RF transmitter signal into an interrogation zone and a receiver receives RF signals from the interrogation zone. The received RF signals include any RF tag signals generated by tags situated in the zone and adapted to respond to the RF transmitter signal. In order to reduce interference effects, the RF carrier frequency of the transmitter signal is adapted to take on a plurality of different frequency values during different ones of a plurality of finite dwell time periods of the RF transmitter signal.

35 Claims, 2 Drawing Sheets

EAS SYSTEM WITH REQUENCY HOPPING

BACKGROUND OF THE INVENTION

This invention relates to electronic article surveillance systems and, in particular, to EAS systems using radio frequency (RF) signals.

U.S. Pat. No. 4,063,229 discloses an EAS system in which RF signals are used to detect the presence of tags in an interrogation zone. In the system of the '229 patent, an RF signal at a predetermined RF carrier frequency is transmitted into the interrogation zone. Each tag in the zone which receives the transmitted RF signal develops and transmits an RF tag signal based thereon. A receiver in the system is responsive to RF signals and processes the RF signals in an attempt to evaluate whether the signals contain an RF tag signal. If the receiver evaluation is that a tag signal is present, an alarm signal is produced indicating the presence of a tag in the zone.

In the '229 patent, one form of the system utilizes RF signals in the microwave frequency range and, in particular, utilizes a microwave carrier frequency at 915 MHz. Each tag in the system, in turn, includes a nonlinear or mixing element which produces a RF tag signal at twice the carrier frequency, i.e. at 1830 MHz.

The RF signals received at the receiver are mixed or compared with a reference signal, i.e., an 1830 MHz signal. If a tag signal is present, a further lower frequency RF signal, i.e., a 30 MHz signal, indicating the presence of the tag signal is produced. This lower frequency signal can then be detected and an alarm signal generated.

Other EAS systems of the RF type utilize two transmitted signals, one an RF signal at a predetermined microwave frequency and a second a modulated signal at a predetermined intermediate frequency (IF). In this type of system, a tag in the interrogation zone receives both the RF signal and the modulated IF signal and mixes the signals. The mixed signals then form an RF tag signal which is transmitted or reradiated by the tag. At the receiver, the received RF signals are also mixed this time with a signal at the RF carrier frequency of the transmitted RF signal.

This mixing produces a mixed signal which contains frequencies indicative of the modulated IF signal content of any RF tag signal which might be present in the received RF signals. The mixed signal is then demodulated to extract any signal content in a frequency band which includes the modulation frequency of the transmitted IF signal. The latter signal content is compared with a signal at the modulation frequency and depending upon the result of the comparison an alarm signal is generated. Systems of this type using RF and IF signals and tags for these systems are disclosed, for example, in U.S. Pat. Nos. 4,139,844, 4,642,640, 4,736,207 and 5,109,217.

All the above EAS systems are subject to interference from sources which transmit signals at or close to the RF frequencies being used in the systems. This interference can mask the RF signals being transmitted by the system transmitter as well as the RF tag signals being received at the system receiver. As a result, the sensitivity of the system is reduced.

Various techniques have been used to compensate for this interference. One technique involves increasing the power of the transmitted RF signal and another technique involves changing the carrier frequency of the transmitted signal. Both techniques, however, have their own disadvantages.

Increasing the power of the RF signal affords only a limited degree of compensation, since the power cannot be increased beyond that allowed by governmental regulations. Also, in order to provide increased power, the components of the system must be enlarged with an accompanying increase in cost. An increase in signal power may also result in signal transmission outside the desired interrogation zone, if the interference source is removed. Finally, increasing the power promotes an escalation of frequency band rivalry.

On the other hand, changing the RF carrier frequency of the transmitted RF signal usually requires that the crystal oscillator employed to generate the carrier be replaced with another oscillator operating at the new carrier frequency. This requires a service person to visit the site where the EAS system is located which is a costly procedure. Also, changing the crystal oscillator does not protect against a new noise source at the new frequency being encountered after the change is made.

It is therefore an object of the present invention to provide an EAS system and method which tend to avoid the above disadvantages.

It is a further object of the present invention to provide an EAS system and method in which interference is more readily avoided.

It is yet a further object of the present invention to provide an EAS system and method in which interference is avoided in a way which helps detect interference frequencies and/or allows operation near the edge of a permissible frequency band.

It is a further object of the present invention to provide an EAS system and method which result in less interference with other systems.

SUMMARY OF THE INVENTION

In accordance with the principles of the present invention, the above and other objectives are realized in an EAS system of the above type in which the transmitter of the system transmits an RF transmitter signal having an RF carrier frequency which is controlled in a specific manner. More particularly, the RF carrier frequency of the transmitter signal is controlled to have a plurality of different values each occurring over a different one of a plurality of finite dwell time periods of the transmitter signal.

Accordingly, the RF carrier frequencies of the transmitter signal and any tag signal will change or hop from one value to another during the detection or operating cycle of the system. As a result, an interfering signal at any one of the RF carrier frequency values will only disturb the transmitter signal and any tag signal during the particular dwell period in which that frequency value is being used. At all other times, the interfering signal will have no substantial degrading effect on the system. The sensitivity of the system is thereby greatly enhanced.

In further accord with the invention, the transmitter signal is also controlled such that the dwell time periods associated with the RF carrier frequency values are spaced from each other by finite time intervals. During these time intervals, the amplitude level of the transmitter signal is reduced relative to the amplitude level of the signal during the dwell time periods. Accordingly, any tag signals which might be produced in each such time interval will be of insignificant magnitude. As a result, during these time intervals, the presence of any appreciable signal content at the system receiver will be indicative of interference in the system and can be monitored to provide a measure of same. Additionally, the reduced amplitude level of the transmitter signal enables the use of RF carrier frequency values which border the edge of the governmentally allowable RF frequency band, since any so-called "frequency overshoot" which occurs will be at such a low level as to satisfy out-of-band governmental regulations.

In the embodiment of the invention to be disclosed hereinbelow, the transmitter of the system also transmits a modulated IF transmitter signal into the interrogation zone. This signal is received by each tag in the zone and mixed with the received RF transmitter signal to develop an RF tag signal. At the receiver, the received RF signals are mixed with a signal at the RF carrier frequency of the RF transmitter signal to produce a mixed signal. This signal includes frequencies indicative of any modulated IF signal contained in any tag signal in the received RF signals. The mixed signal is then processed to detect signal content in a band containing the modulation frequency of the modulated IF signal. The detected signal content is compared with a signal at the modulation frequency and a decision made as to whether a tag signal has been received.

In the disclosed embodiment, the RF carrier frequency of the RF transmitter signal has frequency values in the microwave frequency range, i.e., in the MHz range, and the IF carrier of the modulated IF transmitter signal has a carrier frequency in the kHz frequency range.

DETAILED DESCRIPTION OF THE DRAWINGS

Figure 1:
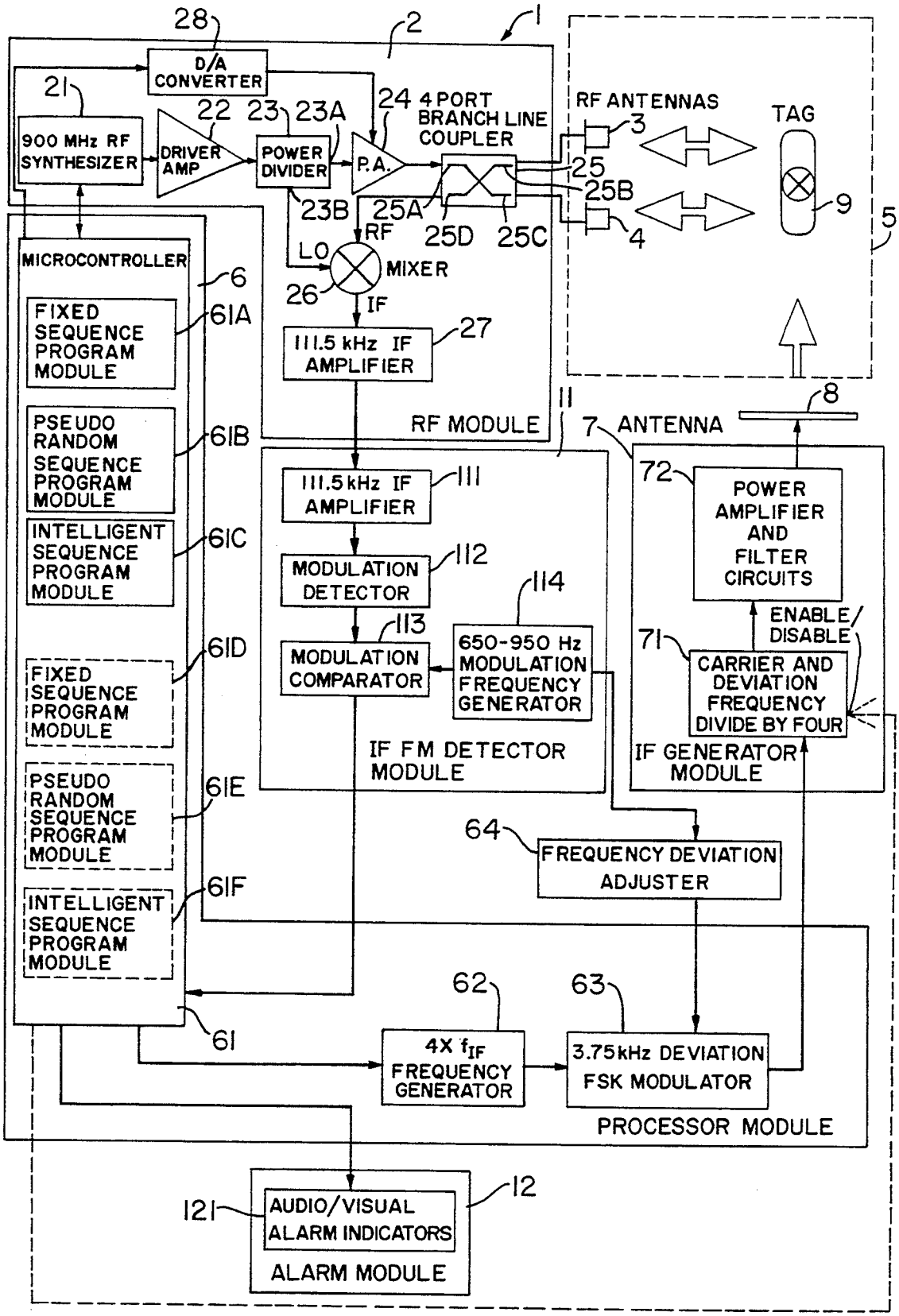
Figure 2:
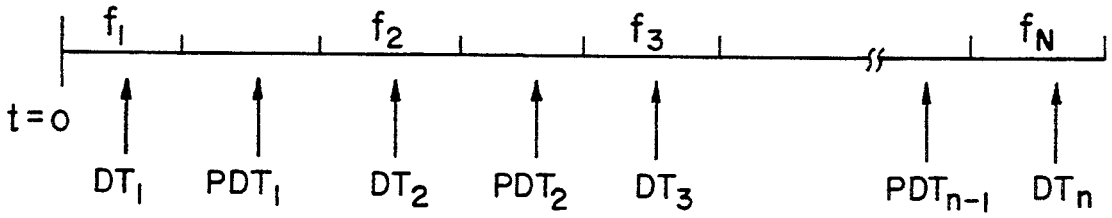

The above and other features and aspects of the present invention will become more apparent upon reading the following detailed description in conjunction with the accompanying drawings, in which:

FIG. 1 shows a block diagram of an EAS system in accordance with the principles of the present invention; and FIG. 2 shows schematically the RF carrier frequency values for the RF transmitter signal of the system of FIG. 1.

DETAILED DESCRIPTION

FIG. 1 shows an EAS system 1 in accordance with the principles of the present invention. As shown, the EAS system comprises an RF module 2 which develops an RF transmitter signal having an RF carrier frequency $f_{RF}$. The RF transmitter signal is fed from the RF module 2 to two RF antennas 3 and 4. The RF antennas 3 and 4 radiate or transmit the RF transmitter signal into an interrogation zone 5.

The RF module 2 comprises a frequency synthesizer 21 which develops a frequency modulated (FM) RF carrier signal at the RF carrier frequency $f_{RF}$ in response to input signals from a program controlled microcontroller 61 included in a processor module 6. The FM RF carrier signal is passed by the synthesizer 21 to a driver amplifier 22 and a power divider 23.

The power divider 23 couples a major part of the FM RF carrier signal from its port 23A to a power amplifier 24 which passes the signal to a first port 25A of a four port directional coupler 25. The coupler 25 directs equal amounts of the carrier signal to its ports 25B and 25C which are coupled to the respective RF antennas 3 and 4. These antennas radiate the FM RF carrier signal as an electromagnetic RF transmitter signal into the interrogation zone 5.

Also transmitted into the interrogation zone 5 is an electric field carrying an IF transmitter signal at an IF carrier frequency $f_{IF}$. This signal is generated by an IF transmitter module 7. The transmitter module 7 receives a frequency-shift-keyed (FSK) IF carrier signal at four times the desired IF carrier frequency $f_{IF}$ and at four times the desired frequency deviation from the processor module 6. The processor module 6 develops the FSK IF signal via a 4 times IF carrier frequency generator 62, a frequency deviation adjuster 64 and an FSK modulator 63.

The modulator 62 is controlled by the microcontroller 61 to develop the $4.f_{IF}$ carrier frequency. The FSK modulator 63 frequency-shift-keys this signal based on a modulation signal from the frequency deviation adjuster 64. The latter, in turn, receives a signal at a modulation frequency $f_M$ generated by a modulation generator 114 and adjusts its amplitude to provide a modulation signal at a frequency $f_M$ and at an amplitude needed to establish the desired four times frequency deviation of the $4.f_{IF}$ carrier.

The signal from the FSK modulator 63 has its frequency and FSK deviation divided by four in a divide by four frequency divider 71 to develop an FSK modulated IF signal at the desired FSK deviation and the desired IF carrier frequency $f_{IF}$. The modulated IF carrier signal is then filtered and amplified in a power amplifier and filter circuit 72. The amplified signal is applied to an electric field antenna 8, shown as a flat metal plate, which produces the IF transmitter signal in an electric field radiated into the interrogation zone 5.

A tag 9 in the interrogation zone 5 is responsive to both the RF transmitter signal and the IF transmitter signal. The tag 9 can be a tag as described in the above-mentioned patents, the teachings of which are incorporated herein by reference. Based on the received signals, the tag performs a mixing operation to develop an RF tag signal. The RF tag signal is related to the product of the RF transmitter signal and the IF transmitter signal and, hence, has RF frequency components indicative of the frequencies $f_{RF}$, $f_{IF}$ and $f_M$. The tag 9 then radiates or transmits the RF tag signal back into the interrogation zone 5.

The antennas 3 and 4 are each responsive to RF signals transmitted into the zone 5 and, hence, are responsive to the tag signal transmitted by the tag 9. The antennas couple the received RF signals to ports 25B and/or 25C, respectively, of the directional coupler 25. From these ports the signals are coupled to the port 25D of the coupler which directs the signals to a mixer 26. The mixer 26 also receives a portion of the RF carrier signal coupled from the port 23B of the power divider 23.

The mixer 26 mixes the RF signals to produce an IF signal having signal content including signals indicative of the IF carrier frequency $f_{IF}$ and the modulation frequency $f_M$. The IF signal is then passed through an IF amplifier 27 in the RF module 2 and through a second IF amplifier 111 in an IF detector module 11. The amplified IF signal is then coupled to a modulation detector 112 having a modulation detection band which includes the modulation frequency $f_M$.

The signals passed by the modulation detector 112 are then coupled to a comparator 113 which compares the signals with the modulation frequency $f_M$ of the modulation frequency generator 114. The result of this comparison is reported to the microcontroller 61. Based upon this reported output result, the microcontroller 61 provides signalling to an audio/visual alarm indicator 121 in an alarm module 12.

When the frequency of the signals detected by the modulation detector 112 are at or close to the modulation frequency $f_M$ of the generator 114, the comparator 113 produces an output result which is recognized by the microcontroller 61 as indicative of the presence of the tag 9 in the zone 5. The microcontroller 61 thereupon sends an alarm signal to the audio/visual alarm indicator 121 causing a sensible alarm to be activated.

In operation of the system 1, if the interrogation zone 5 is subject to other RF signals at or close to the frequencies $f_{RF} \pm f_{IF}$ of the transmitted signals from the modules 2 and 7, these signals will interfere with reception of the RF transmitter signal by the tag 9. These signals will also be received by the antennas 3 and 4 and interfere with recovery by the RF module 2 and the detector module 11 of the signal content at the IF frequency $f_{IF}$ and the signal content at the modulation frequency $f_M$. This, in turn, can result in erroneous comparison outputs being reported by the comparator 113 to the microcontroller 61. As a result, the microcontroller might erroneously not generate an alarm signal, when, in fact, a tag is present in the zone.

In order to reduce these errors, the microcontroller 61 is adapted to control the frequency synthesizer 21 in a specific manner. More particularly, the synthesizer is controlled such that the RF carrier signal produced by the synthesizer and, thus, the resultant RF transmitter signal from the module 2, has a plurality of different frequency values each occurring over a different one of a plurality of finite dwell time periods of the signal. This is shown in FIG. 2, wherein the synthesizer 21 is controlled such that the frequency $f_{RF}$ of its carrier signal and the resultant RF transmitter signal takes on frequency values $f_1 \ldots f_n$ over N successive finite dwell time periods $DT_1$ to $DT_N$.

By controlling the frequency synthesizer 21 in this way, an interfering signal at any one of the RF carrier frequency values will only affect operation of the system 1 during the dwell time period in which that carrier frequency value is being used. As a result, the operation of the system 1 will be substantially unaffected during the remaining time periods. The overall performance of the system 1 will, thus, be enhanced without the need to increase the power of the RF transmitter signal or to physically replace any system components.

The microcontroller 61 can establish the frequency values $f_1$ to $f_n$ of the RF carrier frequency $f_{RF}$ produced by the synthesizer 21 in a variety of ways. Thus, the microcontroller can establish a fixed pattern for the frequency values. The microcontroller can then cause the synthesizer to repeat this fixed pattern over successive detection or operation cycles of the system 1. The fixed pattern established by the microcontroller can also have frequency values which continuously increase or continuously decrease from one value to the next or which are mixed, i.e., some increase and others decrease. Also, the amount of increase and/or decrease can be fixed or variable.

Alternatively, instead of using a fixed pattern for the frequencies, the microcontroller 61 can pseudorandomly determine the frequencies from between upper and lower frequency values during each detection or operation cycle. In such case, before each dwell period is completed, a pseudorandom operation would be performed by the microcontroller so as to determine its output to be used to establish the next frequency value. The synthesizer would then be addressed by the microcontroller with this output to provide this next frequency value during the next dwell time period.

Another alternative for establishing the frequency values is for the microcontroller 61 to do so with a so-called "intelligence" function. This function would enable the microcontroller to establish the next frequency value based on sensed system conditions. In such case, the intelligence function would assess these conditions and, based on this assessment, would select the frequency value for the next dwell time period of operation.

In FIG. 1, the aforesaid alternative methods of establishing the frequency values are carried out by the microcontroller 61 via three program modules. Thus, program module 61A provides a fixed sequence of output microcontroller values for controlling the frequency synthesizer 21 to establish a fixed sequence of frequency values. Program module 61B, in turn, provides pseudorandomly determined microcontroller outputs for establishing a pseudorandom sequence of frequency values and program module 61C provides microcontroller outputs based upon an intelligence function to establish an intelligence based sequence of frequency values.

As part of each frequency sequence, each module 61A–61C can also determine the extent of the finite dwell period of its determined frequency values. These periods also may continuously increase or continuously decrease or may be mixed, i.e., some may increase and another may decrease.

In further accordance with the invention, the microcontroller 61 further controls the system 1 such that between the dwell periods in which the transmission of different RF carrier frequency values takes place, the amplitude of the RF transmitter signal is significantly reduced. This is accomplished by the controller 61 signalling via the digital-to-analog converter 28, the power amplifier 22 to power down during the time intervals $PDT_1$ to $PDT_N$ separating the dwell time periods $DT_1$ to $DT_n$. FIG. 2 illustrates this in the frequency pattern for the frequency values.

Use of the power down time intervals $PDT_1$ to $PDT_n$ enables the system 1 to both detect the presence of interference as well as to operate over a frequency band which extends to the edges of the governmentally allowable RF frequency band. The ability to detect interference results from the fact that during the power down intervals, no appreciable RF transmitter signals are generated and, as a result, no appreciable tag signals are generated. Accordingly, if there is any significant signal received by the RF module 2 during a power down interval, this is an indication that there are interfering signals present within the interrogation zone 5.

The ability to operate the system 1 near the band edge allowed by governmental regulation is also made possible as a result of the power down intervals. If the synthesizer 21, in changing to a frequency value near the permissible band edge, momentarily overshoots the band edge so that an unpermitted frequency is generated, this now occurs during power down and, thus, at a much reduced amplitude level. By ensuring that the reduced amplitude level is allowable for the unpermitted or out-of-band frequency and that the power down interval is at least as long as the settling time of the synthesizer, the governmental regulations can be satisfied, while frequency values near the band edge can simultaneously be used.

As shown in FIG. 2, each power down interval is of equal extent. However, the controller 61 can control the amplifier 22 so that the intervals increase or decrease continuously in extent or are mixed, i.e., some increase and some decrease. Also, it is not necessary that there be a power down interval between each frequency value. Such intervals need only be employed for frequency values near the permissible band edges or, if operation of the system is not to be near the band edges, no power down intervals need be employed at all. In such case, the dwell time periods would directly follow one another.

In the system 1 as illustrated in FIG. 1, the controller 61 has been described as causing a change or hop in the RF carrier frequency values of the RF transmitter signal. The microcontroller 61 can also be used to provide a similar change or hopping of the carrier frequency $F_{IF}$ of the IF transmitter signal. This can be accomplished by the microcontroller establishing suitable output signals to control the IF carrier frequency generator 62. To this end, the microcontroller 61 can include additional program modules 61D, 61E and 61F (shown in dotted line) to provide fixed, pseudorandom or intelligence determined output values to establish a corresponding fixed, pseudorandom and intelligence pattern of IF carrier frequency values for the generator 62.

Additionally, the microcontroller 61 can provide power down intervals between successive dwell periods of the hopped IF carrier frequency $f_{IF}$. These intervals can be established by the microcontroller suitably addressing via a control line (shown in dotted line) the enable/disable port of the divide-by-four circuit 71 of the IF generator module 7.

In a representative form of the system 1, the system might utilize for the RF carrier frequency $f_{RF}$, frequency values in the microwave frequency band 902–928 MHz or, more particularly, might utilize 60 frequency values in the band 902–905 MHz. Each dwell period, in turn, might be approximately 0.4 seconds. The IF carrier frequency $F_{IF}$ might be in a range of 40–150 kHz and, more particularly, might be at 111.5 kHz. The FSK modulation frequency $f_M$ might be in a range of 650–950 Hz and the FSK deviation might have a value of 3.75 kHz. The FM modulation on the RF carrier might have a frequency of 1.2 kHz and a frequency deviation of 1.6 kHz. The system might also be designed to satisfy FCC part 15,247.

In all cases it is understood that the above-described arrangements are merely illustrative of the many possible specific embodiments which represent applications of the present invention. Numerous and varied other arrangements, can be readily devised in accordance with the principles of the present invention without departing from the spirit and scope of the invention.

What is claimed is:

1. An EAS system for use with a tag, said EAS system comprising:

transmitting means for transmitting an RF transmitter signal into an interrogation zone, said RF transmitter signal having a RF carrier which is controlled by said transmitting means to have a plurality of different values each occurring over a different one of a plurality of finite dwell time periods of said RF transmitter signal, each finite dwell time period being spaced by a finite time interval from the preceding finite dwell time period;

and receiving means adapted to be responsive to RF signals for making a determination and providing an indication that an RF tag signal has been received, said RF tag signal being produced by said tag in response to said RF transmitter signal and having a RF carrier frequency whose value is related to the value of the RF carrier of said RF transmitter signal.

2. An EAS system in accordance with claim 1 wherein:

each finite dwell time period has an extent which is equal to the extent of each of the other finite dwell time periods.

3. An EAS system in accordance with claim 1 wherein:

each finite dwell time period has an extent which is greater than the extent of the preceding finite dwell time period.

4. An EAS system in accordance with claim 1 wherein:

each finite dwell time period has an extent which is less than the extent of the preceding dwell time period.

5. An EAS system in accordance with claim 1 wherein:

said transmitter means determines as to whether the extent of a particular finite dwell time period is equal to, greater than or less than the preceding finite dwell time period one of fixedly and pseudorandomly.

6. An EAS system in accordance with claim 1 wherein:

said RF transmitter signal is controlled to be at a reduced amplitude level during each of said finite time intervals relative to the amplitude level of said RF transmitter signal during each of said finite dwell time periods.

7. An EAS system in accordance with claim 6 wherein:

said reduced amplitude level is at or less than the level allowed by governmental regulations for out-of-band signals.

8. An EAS system in accordance with claim 6 wherein:

said plurality of different values of said RF carrier are within a predetermined RF frequency band;

and said receiving means is responsive to signals within said RF frequency band and when said receiving means receives a signal during a finite time interval said receiving means identifies the presence of interference.

9. An EAS system in accordance with claim 1 wherein:

said transmitter means controls said RF transmitter signal such that each of said plurality of different values of said RF carrier frequency of said RF transmitter signal is one of: selected to be greater than the preceding value in accordance with a predetermined fixed sequence; selected to be less than the preceding value in accordance with a predetermined fixed sequence; and selected pseudorandomly.

10. An EAS system in accordance with claim 1 wherein:

said transmitter means further transmits an IF transmitter signal at an IF carrier frequency into said interrogation zone;

said tag signal is related to said IF carrier frequency, said tag including first means for mixing said RF transmitter signal and said IF transmitter signal to develop said tag signal;

and said receiving means includes second means for mixing any received RF signals with the RF carrier frequency of said RF transmitter signal to extract and "first" signal content in a band including said IF carrier frequency.

11. An EAS system in accordance with claim 10 wherein:

said IF carrier frequency is modulated based upon a modulation frequency;

said tag signal is related to said modulation frequency;

and said receiving means includes: means for detecting in said "first" signal content and "second" signal content in a band including said modulation frequency; and means for comparing said detected "second" signal content with a signal at said modulation frequency.

12. An EAS system in accordance with claim 10 wherein:

the RF carrier frequency of said RF transmitter signal is in the 902–928 MHz frequency range;

and said IF carrier frequency of said IF transmitter signal is in the 40–150 kHz frequency range.

13. An EAS system in accordance with claim 10 wherein:

said RF carrier frequency of said RF transmitter signal is in the microwave frequency range (i.e., greater than about 900 MHz).

14. An EAS system in accordance with claim 10 wherein:

said RF carrier of said RF transmitter signal is frequency modulated.

15. An EAS system in accordance with claim 10 wherein:

said transmitting means controls said IF carrier frequency to have a plurality of different values each occurring over a different one of a plurality further finite dwell periods of said IF transmitter signal.

16. An EAS system in accordance with claim 15 wherein:

each further finite dwell period is spaced by a further finite time interval from the preceding further finite dwell period;

and said IF transmitter signal is controlled to be at a reduced amplitude level during each of said further finite time intervals relative to the amplitude level of said IF transmitter signal during each of said further finite dwell periods.

17. An EAS system in accordance with claim 1 wherein:

said RF carrier frequency of said RF transmitter signal is at a microwave frequency (i.e., greater than about 900 MHz).

18. An EAS system in accordance with claim 1 further comprising:

said tag.

19. A method of operating an EAS system for use with a tag, said method comprising:

transmitting an RF transmitter signal into an interrogation zone, said RF transmitter signal having a RF carrier frequency which is controlled to have a plurality of different values each occurring over a different one of a plurality of finite dwell time periods of said RF transmitter signal, each finite dwell time period being spaced by a finite time interval from the preceding finite dwell time period;

receiving RF signals;

determining whether an RF tag signal is included in said received RF signals, said RF tag signal being produced by said tag in response to said RF transmitter signal and having an RF carrier frequency whose value is related to the value of the RF transmitter signal; and generating an indication that a RF tag signal has been received.

20. A method in accordance with claim 19 wherein:

each finite dwell time period has an extent which is equal to the extent of each of the other finite dwell time periods.

21. A method in accordance with claim 19 wherein:

each finite dwell time period has an extent which is greater than the extent of the preceding finite dwell time period.

22. A method in accordance with claim 19 wherein:

each finite dwell time period has an extent which is less than the extent of the preceding dwell time period.

23. A method in accordance with claim 19 wherein:

the determination as to whether the extent of a particular finite dwell time period is equal to, greater than or less than the preceding finite dwell time period is made one of fixedly and pseudorandomly.

24. An EAS system in accordance with claim 19 wherein:

said RF transmitter signal is at a reduced amplitude level during each of said finite time intervals relative to the amplitude level of said RF transmitter signal during each of said finite dwell time periods.

25. A method in accordance with claim 24 wherein:

said reduced amplitude level is at or less than the level allowed by governmental regulations for out-of-band signals.

26. A method in accordance with claim 19 wherein:

said plurality of different values of said RF carrier frequency are within a predetermined RF frequency band;

and said method further includes identifying the presence of interference in said system when RF signals within said RF frequency band are received during one of said finite time intervals.

27. A method in accordance with claim 19 wherein:

each of said plurality of different values of said RF carrier frequency of said RF transmitter signal is one of: selected to be greater than the preceding value in accordance with a predetermined fixed sequence; selected to be less than the preceding value in accordance with a predetermined fixed sequence; and selected pseudorandomly.

28. A method in accordance with claim 19 further comprising:

transmitting an IF transmitter signal at an IF carrier frequency into said interrogation zone;

said tag signal being related to said IF carrier frequency, said tag producing said tag signal by mixing said RF transmitter signal and said IF transmitter signal;

and said step of receiving includes mixing any received RF signals with the RF carrier frequency of said RF transmitter signal to extract first signal content in a band including said IF carrier frequency.

29. A method in accordance with claim 28 wherein:

said IF carrier frequency is modulated based upon a modulation frequency;

said tag signal is related to said modulation frequency;

and said step of receiving further includes: detecting from said "first" signal content and "second" signal content in a band including said modulation frequency;

and comparing said detected "second" signal content with a signal at said modulation frequency.

30. A method in accordance with claim 28 wherein:

the RF carrier frequency of said RF transmitter signal is in the MHz frequency range;

and said IF carrier frequency of said IF transmitter signal is in the kHz frequency range.

31. A method in accordance with claim 28 wherein:

said RF carrier of said RF transmitter signal is in the microwave frequency range.

32. A method in accordance with claim 28 wherein:

said RF carrier frequency of said RF transmitter signal is frequency modulated.

33. A method in accordance with claim 28 wherein:

said IF carrier frequency has a plurality of different values each occurring over a different one of a plurality further finite dwell periods of said IF transmitter signal.

34. A method in accordance with claim 33 wherein:

each further finite dwell period is spaced by a further finite time interval from the preceding further finite dwell period;

and said IF transmitter signal is at a reduced amplitude level during each of said further finite time intervals relative to the amplitude level of said IF transmitter signal during each of said further finite dwell periods.

35. A method in accordance with claim 19 wherein:

said RF carrier frequency of said RF transmitter signal is at a microwave frequency.

* * * * *

UNITED STATES PATENT AND TRADEMARK OFFICE

CERTIFICATE OF CORRECTION

PATENT NO. : 5,349,332

DATED : September 20, 1994

INVENTOR(S) : David B. Ferguson et al.

It is certified that error appears in the above-indentified patent and that said Letters Patent is hereby corrected as shown below:

On the title page, item [54] and column 1, line 2, change "REQUENCY" to --FREQUENCY--.

Col. 1, line 25. Change "a" to -- an --.

Col. 9, line 11. Change "and" to -- any --.

Col. 9, line 44. After "plurality" insert -- of --.

Col. 11, line 1. Change "first" to -- any "first" --.

Signed and Sealed this

Twenty-seventh Day of December, 1994

*Attest:*

Bruce Lehman

BRUCE LEHMAN

*Attesting Officer*

*Commissioner of Patents and Trademarks*